US010597903B2

(12) United States Patent
Reeves

(10) Patent No.: US 10,597,903 B2
(45) Date of Patent: Mar. 24, 2020

(54) SYSTEMS AND METHODS OF SECURING ITEMS AND VERIFYING THE SAME

(71) Applicant: Andrew C. Reeves, Everett, WA (US)

(72) Inventor: Andrew C. Reeves, Everett, WA (US)

( * ) Notice: Subject to any disclaimer, the term of this patent is extended or adjusted under 35 U.S.C. 154(b) by 0 days.

(21) Appl. No.: 15/965,177

(22) Filed: Apr. 27, 2018

(65) Prior Publication Data

US 2019/0330884 A1 Oct. 31, 2019

(51) Int. Cl.

| | |
|---|---|
| ***E05B 41/00*** | (2006.01) |
| ***G07C 9/00*** | (2020.01) |
| ***F41A 17/06*** | (2006.01) |
| *E05B 47/00* | (2006.01) |

(52) U.S. Cl.

CPC ..... *E05B 41/00* (2013.01); *F41A 17/06* (2013.01); *G07C 9/00912* (2013.01); *E05B 2047/0091* (2013.01); *G07C 2209/62* (2013.01)

(58) Field of Classification Search

CPC ..... G06K 19/07798; G06K 19/06037; G06K 7/0008; G06K 17/00; B65D 55/026; B65D 55/028; E05B 41/00; G07C 9/00; G07C 9/00912

See application file for complete search history.

(56) References Cited

U.S. PATENT DOCUMENTS 4,204,709 A * 5/1980 Shea ..... G07F 9/06 292/282
5,219,194 A * 6/1993 Trent ..... G09F 3/0352 24/703.1
5,715,586 A * 2/1998 Citron ..... G07F 9/06 29/235
6,069,563 A * 5/2000 Kadner ..... G08B 13/06 340/539.1
6,109,673 A * 8/2000 Olshausen ..... G09F 3/0317 292/307 A (Continued)

OTHER PUBLICATIONS

App Lock software application, https://highsecure-app-lock.appedia.net/?gclid=EAIaIQobChMlhtKehOzI2AIVVbjACh2ZDg11EAAYBSAAEgKFRvD_BwE; last accessed Sep. 7, 2018.

(Continued)

*Primary Examiner* — Hoi C Lau
(74) *Attorney, Agent, or Firm* — Kutak Rock LLP

(57) ABSTRACT

A system for and method of verifying a configuration of an artifact, such as a gun, a phone, or other artifact, is provided. The system includes a plurality of unique verification mechanisms, each verification mechanism including a unique identifier for distinguishing the verification mechanism from each of the other verification mechanisms. The method includes engaging a verification mechanism with the artifact and/or with an object and/or device associated with the artifact so as to move the artifact to a verifiable configuration while simultaneously moving the verification mechanism to a verifying configuration. The method further includes scanning the verification mechanism to create a first verification record, thereby providing evidence of such configurations. The verification mechanism is configured such that moving the artifact away from the verifiable configuration moves the verification mechanism away from the verifying configuration, thereby preventing the verification mechanism from moving back to the verifying configuration.

20 Claims, 5 Drawing Sheets

(56) References Cited

U.S. PATENT DOCUMENTS 6,420,971 B1 * 7/2002 Leck ..... E05B 39/04 340/542
6,536,815 B1 * 3/2003 Liroff ..... G09F 3/0352 292/1
6,747,558 B1 * 6/2004 Thorne ..... G06K 19/07798 340/545.6
6,888,241 B1 * 5/2005 Korn ..... G09F 3/0323 257/728
7,052,055 B1 * 5/2006 Castro ..... G09F 3/037 24/16 PB
7,063,362 B1 * 6/2006 Liroff ..... G09F 3/0352 24/115 H
7,109,847 B1 * 9/2006 Hill ..... G09F 3/0335 340/309.16
7,209,029 B2 4/2007 Coelho et al.
7,740,292 B1 * 6/2010 Fattori ..... B65D 90/22 292/307 R
7,899,936 B2 3/2011 Fredriksson et al.
7,973,664 B1 * 7/2011 Lambert ..... B29C 65/3644 235/385
8,052,180 B1 * 11/2011 Lassen ..... B65D 90/22 292/307 A
8,186,731 B1 * 5/2012 Romero ..... G09F 3/0358 292/307 B
8,275,995 B2 9/2012 Jobmann
9,000,917 B1 * 4/2015 Meyers ..... G08B 26/007 340/539.31
9,070,231 B1 * 6/2015 Meyers ..... G07C 9/00158
9,109,378 B2 8/2015 Scalisi
9,177,282 B2 * 11/2015 Stevens ..... G06Q 10/0833
9,501,046 B2 11/2016 Kalous et al.
9,516,395 B2 12/2016 Foster, III
9,703,931 B2 7/2017 Hinkel
9,726,448 B1 8/2017 Milde, Jr. et al.
9,807,069 B2 10/2017 Maher et al.
10,145,146 B2 * 12/2018 Mullis ..... E05B 39/04
2003/0173408 A1 * 9/2003 Mosher, Jr. ..... A61B 5/117 235/492
2004/0008585 A1 * 1/2004 Augspurger ..... G04B 37/1486 368/101
2004/0012211 A1 * 1/2004 Burt ..... G09F 3/0352 292/327
2004/0100379 A1 * 5/2004 Boman ..... G06Q 10/047 340/539.26
2004/0108938 A1 * 6/2004 Entrekin ..... G07C 9/00309 340/5.73
2004/0215532 A1 * 10/2004 Boman ..... G06Q 10/06 705/28
2004/0227630 A1 * 11/2004 Shannon ..... G08B 13/2462 340/539.22
2005/0046567 A1 * 3/2005 Mortenson ..... G06Q 10/047 340/539.13
2005/0108044 A1 * 5/2005 Koster ..... G06Q 50/22 705/2
2005/0179545 A1 * 8/2005 Bergman ..... G08B 13/08 340/545.2
2005/0231365 A1 * 10/2005 Tester ..... G06K 19/07798 340/568.1
2005/0252259 A1 * 11/2005 Ekstrom ..... B65D 90/00 70/257
2006/0080819 A1 * 4/2006 McAllister ..... G06K 17/00 29/403.3
2006/0087431 A1 * 4/2006 Shieh ..... B65D 63/1081 340/572.1
2006/0109106 A1 * 5/2006 Braun ..... G06Q 10/08 340/539.13
2006/0202824 A1 * 9/2006 Carroll ..... G06Q 10/087 340/568.1
2006/0225332 A1 * 10/2006 Zenisek ..... G09F 3/10 40/638
2006/0238341 A1 * 10/2006 Commagnac ..... B65D 55/02 340/568.1
2006/0290147 A1 * 12/2006 Liroff ..... G09F 3/0352 292/327
2007/0001855 A1 * 1/2007 Bohman ..... B65D 90/00 340/572.1
2007/0120381 A1 * 5/2007 Ehrensvard ..... G08B 13/1445 292/307 R
2007/0126578 A1 * 6/2007 Broussard ..... G06K 17/0022 340/572.1
2007/0210173 A1 * 9/2007 Nagel ..... G06K 7/0008 235/492
2007/0273484 A1 * 11/2007 Cederlof ..... H04W 52/0225 340/10.33
2008/0042842 A1 * 2/2008 Ulibarri ..... G06Q 10/08 340/572.1
2008/0054059 A1 * 3/2008 Chadima ..... B65D 5/685 229/125.38
2008/0157975 A1 * 7/2008 White ..... B65D 55/02 340/572.7
2008/0245791 A1 * 10/2008 Atherton ..... B65D 5/4233 220/200
2008/0252450 A1 * 10/2008 Wandel ..... B65D 55/026 340/541
2008/0258401 A1 * 10/2008 Cotton ..... B65D 55/028 277/321
2010/0141381 A1 6/2010 Bliding et al.
2011/0012731 A1 * 1/2011 Stevens ..... G01S 5/0027 340/539.31
2012/0004761 A1 * 1/2012 Madruga ..... G06Q 30/02 700/214
2012/0235815 A1 * 9/2012 Coveley ..... G06K 19/07749 340/545.6
2012/0248057 A1 * 10/2012 Bogle ..... A61J 1/1406 215/43
2013/0257590 A1 10/2013 Kuenzi et al.
2015/0090625 A1 * 4/2015 Bauss ..... B65D 23/085 206/459.5
2015/0228137 A1 8/2015 Chen et al.
2016/0042582 A1 2/2016 Hyde et al.
2016/0358397 A1 12/2016 Kristensen et al.
2017/0024989 A1 * 1/2017 Coveley ..... B65D 55/02
2017/0098335 A1 4/2017 Payack, Jr.
2017/0236352 A1 8/2017 Conrad et al.
2018/0144573 A1 * 5/2018 Finkenzeller .... G06K 19/07798
2018/0240065 A1 * 8/2018 Hilsley ..... G06K 19/06037

OTHER PUBLICATIONS

DateStamper sofware application, Jordan Hipwell, https://itunes.apple.com/us/app/datestamper/id916281570?mt=8; last accessed Sep. 7, 2018.

* cited by examiner

SYSTEMS AND METHODS OF SECURING ITEMS AND VERIFYING THE SAME

FIELD OF THE INVENTION

The present invention relates generally to systems and methods of securing items. More specifically, the present invention is concerned with systems and methods of verifying a secure status of an item.

BACKGROUND

Many items, such as guns, money, liquor, and the like are secured in various locations, such as cabinets, safes, bags, and the like. For instance, guns are often stored in holsters and/or bags when they are not required. In this way, the gun owner can discretely carry the gun in public and/or can reduce the likelihood that someone will try to steal the gun and/or try to use the gun improperly. Unfortunately, while carrying a gun has many benefits for personal safety and protection, it can also subject the gun owner to accusations of improperly brandishing the gun, such as in a threatening manner, and/or other serious accusations. When faced with such accusations, the gun owner is often left with little to no ability to disprove such accusations. Consequently, it would be beneficial to have a system for and method of verifying a configuration of a gun and/or other item, thereby providing evidence that the gun in question was not brandished and/or otherwise used during such confrontation. It would further be beneficial if such evidence was independently verifiable. It would further be beneficial if such evidence could be authenticated, such as by an officer or other third-party.

Phone users also often must contend with accusations of improper use and/or temptations to improperly use a phone. For instance, a driver may be accused of texting while driving and/or may be tempted to text while driving if a phone is accessible to the driver. Similarly, a student may be accused of cheating and/or may be tempted to cheat if a phone or other electronic device is accessible to the student during a test. Consequently, it would be beneficial to have a system for and method of securing a phone or other device while driving or taking a test. It would further be beneficial if such system and method provided evidence that at least certain functions of the phone, such as a touch screen, were inaccessible to a user during a certain time, such as at the time of a vehicle accident or during a test. I would further be beneficial if such evidence was independently verifiable. It would further be beneficial if such evidence could be authenticated, such as by an officer, a test administrator, or some other third party.

In many cases, the desire for quick and easy access to items causes some users to forego locking up items that they or others would otherwise prefer be secured. For instance, the desire to have quick and easy access to a gun during an emergency causes some users to forego locking up guns in certain situations, such as when the gun is located at the user's home, on the user's body, and/or in the user's vehicle. Sometimes, failure to lock up such items can lead to disaster, such as accidental shootings by curious children. Other times, locking up such items can also lead to disaster, such as unavailability of a gun during a critical situation due to a lost key, a forgotten combination, and/or insufficient time to use a key and/or enter a combination, especially during stressful situations. Consequently, it would be beneficial to have a securing and/or verification device that could quickly and easily be dispatched so as to allow a user to quickly and easily obtain access to a gun or other item.

In many cases, keys and combinations alone are insufficient to properly safeguard items, such as guns, money, liquor, or the like. For instance, children or others may gain access to a key, may be able to pick a lock, and/or may be able to guess or otherwise obtain a combination. In some such circumstances, such individuals may gain access to such items without the owners of such items ever knowing, such as by returning locking such items back up. In some such circumstances, it would be beneficial to have a unique verification mechanism for verifying whether someone has gained access to such items and/or to otherwise discourage such persons for improperly gaining access to such items. It would further be beneficial if such verification mechanisms did not discourage authorized individuals from accessing such items during appropriate times.

SUMMARY

The present invention comprises a system for and a method of verifying a configuration of an object at a specified time. In this way, users can obtain independent verification that a gun, a phone, and/or some other device was not accessed during a crucial time, such as during an altercation, an accident, a test, or some other time of interest. In some embodiments, the system includes a plurality of interchangeable verification mechanisms, such as serialized bands or the like. Each verification mechanism is unique so that one verification mechanism can be distinguished from another.

The method includes moving one or more item (i.e. a gun, a phone, money, liquor, or any other item) to a verifiable configuration by engaging a verification mechanism with the item and/or an object associated with the item (i.e. a bag, a safe, a box, and/or any other associated object). In this way, the verification mechanism is moved to a verifying configuration. The method further includes scanning a unique identifier of the verification mechanism and generating a verification record associated with such scan. Subsequent scans are then compared with one or more previous scans to determine when and if the verification mechanism has been replaced or removed, thereby providing an indication of whether the item could have been moved from a secured configuration.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

Figure 1A:
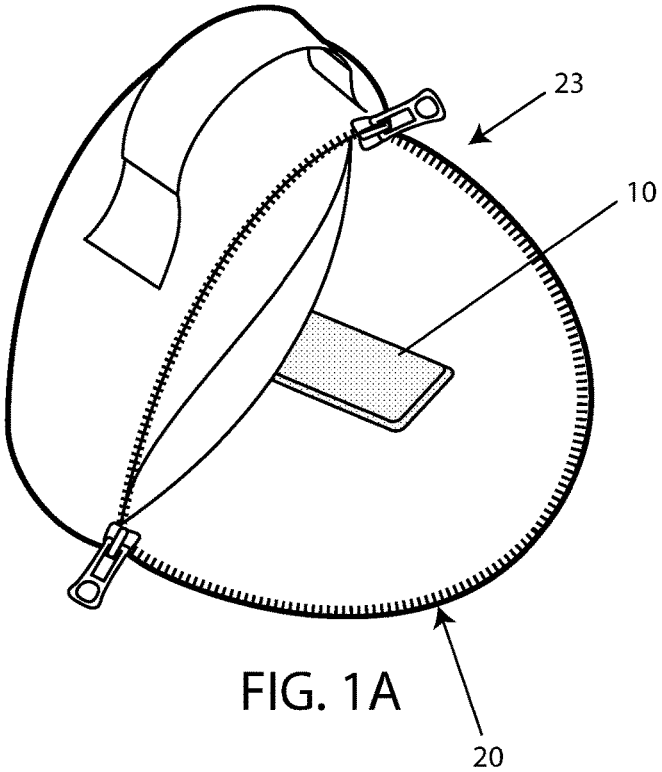
FIG. 1A shows a holding device, the holding device being a bag and being shown in an open configuration with an artifact positioned within an interior area of the holding device.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention is directed to a system for and a method of securing items and for obtaining verification of the same. In some embodiments, the method includes moving an item from an unsecured configuration to a secured configuration. In some embodiments, the item is a gun, a mobile device such as a mobile phone, an alcoholic beverage, contraband, and/or any other item or device that is and/or that can be selectively secured (herein, each being an "artifact" 10). In some embodiments, moving an artifact 10 to a secured configuration includes positioning the artifact 10 within another item (i.e. a "holding device" 20), engaging the item with one or more other item (i.e. an "engagement device" 30), positioning the artifact in close proximity to one or more other item (i.e. a "proximity device" 40), and/or otherwise utilizing one or more other item and/or device (herein, each holding device 20, engagement device 30, proximity device 40, and other item and/or device being a "securing device").

In some embodiments, a securing device is utilized to store the artifact 10 when the artifact 10 is not in use; to at least partially conceal the artifact 10 when necessary and/or desired; to make the artifact 10 at least somewhat inaccessible (to an owner, permissive user, non-permissive user, or otherwise); and/or to otherwise assist in at least partially moving the artifact 10 to a secured configuration. In some embodiments, a verification mechanism 50 is utilized to move a securing device and/or an artifact 10 to a verifiable configuration, thereby allowing a user and/or system to verify a status and/or configuration of one or more artifact 10 and/or securing device. In some embodiments, moving a securing device and/or an artifact 10 to a verifiable configuration includes moving the securing device and/or the artifact 10, as applicable, to a secured configuration and moving a verification mechanism 50 to a verifying configuration.

Holding Devices

Figure 1B:
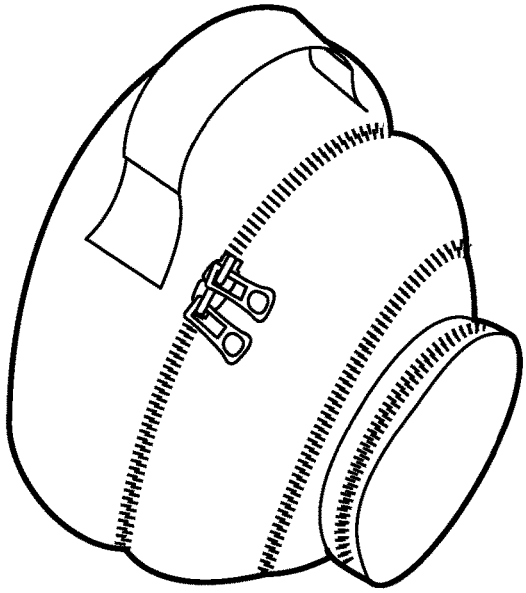
FIG. 1B shows the holding device of FIG. 1A, the holding device being shown in a closed configuration.
Figure 1C:
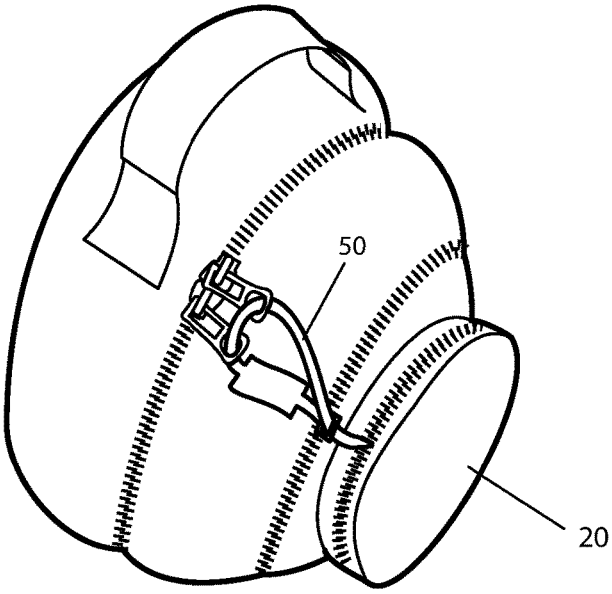
FIG. 1C shows the holding device of FIG. 1A, the holding device being shown in a verifiable configuration.
Figure 2A:
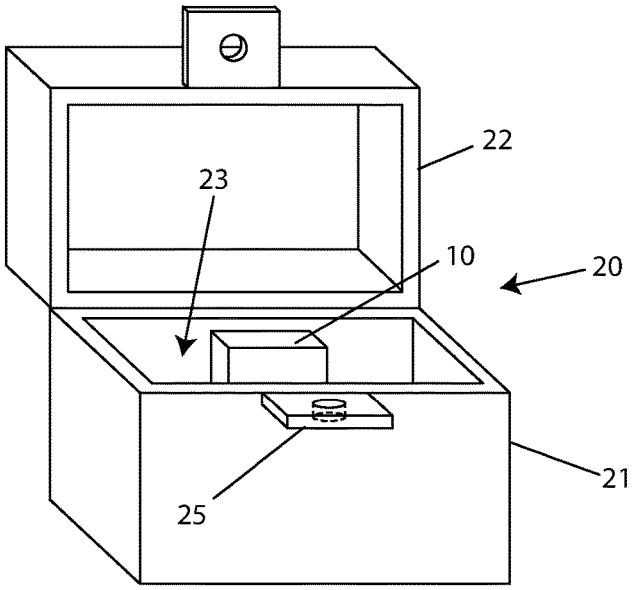
FIG. 2A shows a holding device, the holding device being a box and being shown in an open configuration with an artifact positioned within an interior area of the holding device.
Figure 2B:
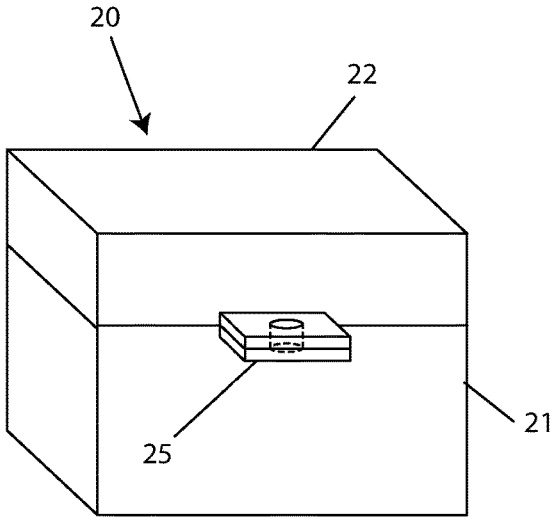
FIG. 2B shows the holding device of FIG. 2A, the holding device being shown in a closed configuration.
Figure 2C:
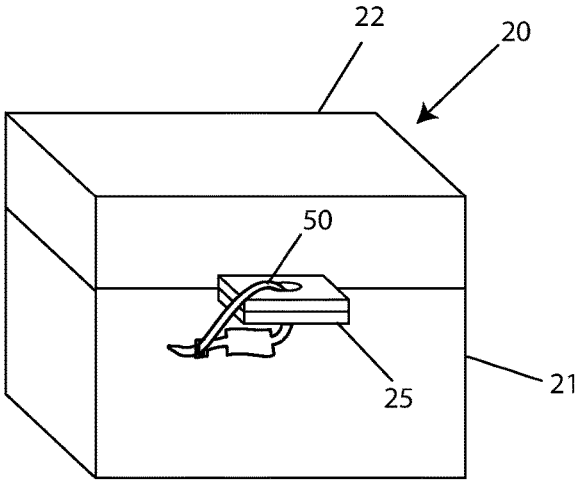
FIG. 2C shows the holding device of FIG. 2A, the holding device being shown in a verifiable configuration.
Figure 3A:
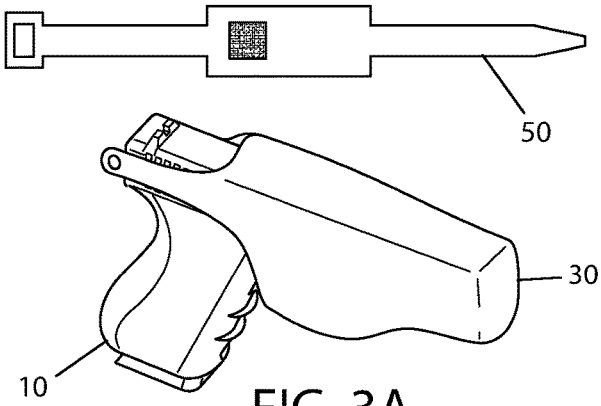
FIG. 3A shows an artifact engaged with an engaging device, the artifact being a gun and the engaging device being shown in an engaged configuration.
Figure 3B:
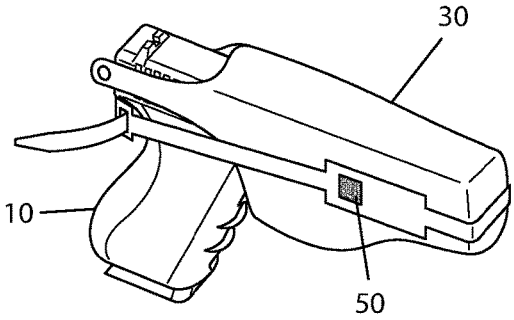
FIG. 3B shows the artifact and engaging device of FIG. 3A, the artifact being shown in a verifiable configuration and a verification mechanism shown in a verifying configuration.
Figure 3C:
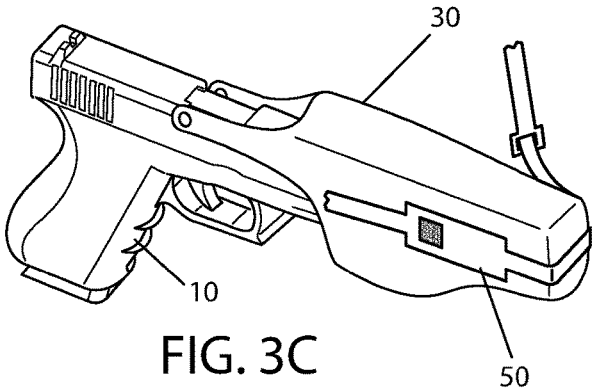
FIG. 3C shows the artifact and engaging device of FIG. 3A, the artifact being shown after it is moved away from the verifiable configuration.
Figure 3D:
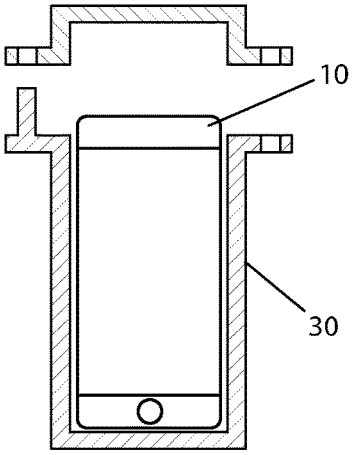
FIG. 3D shows an artifact partially engaged with an engaging device, the artifact being a mobile device and the engaging device being shown in a partially disengaged configuration.
Figure 3E:
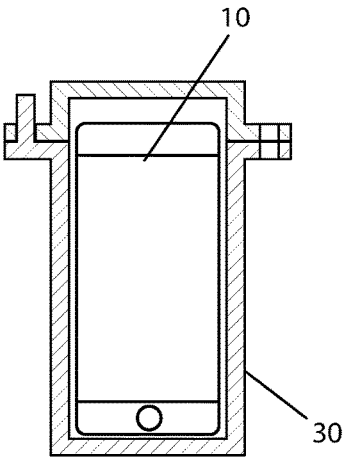
FIG. 3E shows the artifact and engagement device of FIG. 3D, the artifact being shown in a verifiable configuration and the engagement device being shown in a fully engaged configuration.
Figure 3F:
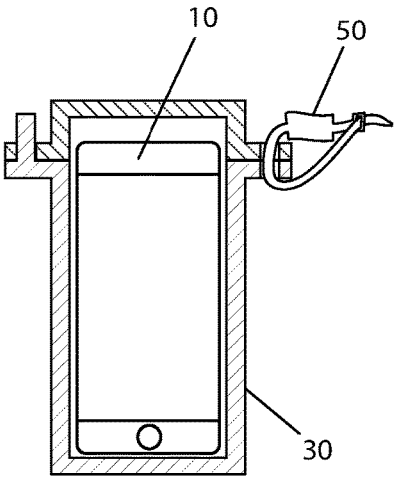
FIG. 3F shows the artifact of FIG. 3D, the artifact shown in a verifiable configuration and a verification mechanism shown in a verifying configuration.

Referring to FIGS. 1A and 2A, some methods of the present invention include placing one or more artifact 10 within an inner volume 23 of a holding device 20 and moving the holding device 20 to a secured configuration, thereby moving the artifact 10 to a secured configuration. In some embodiments, the holding device 20 is moveable between an open configuration (see FIGS. 1A and 2A) for ingress and/or egress of the artifact 10 and a closed configuration (see FIGS. 1B and 2B) for preventing or otherwise inhibiting ingress and/or egress of the artifact 10. In some embodiments, the secured configuration of the artifact 10 coincides with the artifact 10 being positioned within the inner volume 23 of the holding device 20 while the holding device 20 is in a closed configuration.

In some embodiments, the holding device 20 are moveable to a reinforced and/or sealed configuration (herein each a "sealed configuration") for securing the holding device 20 in the closed configuration and/or for preventing or otherwise inhibiting ingress and/or egress of items (such as items that are smaller than the artifact) and/or substances (i.e. dirt, oil, water, air, or the like). In some embodiments, the sealed configuration of the holding device 20 coincides with a closed configuration of the holding device 20. In some embodiments, the holding device 20 is moveable from the sealed configuration to one or more unsealed configuration, thereby allowing the holding device to move to the open configuration and/or for allowing ingress and/or egress of one or more item and/or substance. In some embodiments, each unsealed configuration of the holding device 20 coincides with an open configuration or a closed configuration of the holding device.

In some embodiments, the holding device 20 is a bag having generally flimsy walls, such as a mail bag, a bank bag, a gun bag, a duffle bag, a backpack, or the like. In some embodiments, the holding device 20 defines an inner volume 23 having a transitory shape and/or size, thereby facilitating efficient storage of one or more artifact within such holding device 20 while also facilitating ease of storage and/or transportation of such holding device 20. In some embodiments, one or more wall of the holding device 20 is configured to deform against one or more edge, side, and/or other feature of the artifact, thereby providing a visual indication of when the holding device 20 is in use and/or an indication of an identification of an artifact positioned within an inner volume 23 of the holding device 20. In some embodiments, the holding device 20 includes one or more securing feature, such as a zipper or the like, that is moveable between a first configuration and a second configuration, thereby moving the holding device 20 between an open configuration and a closed configuration, respectively.

In some embodiments, the holding device 20 is a safe, a box (such as a toolbox, a tackle box, a footlocker, a filing cabinet, a glove box, or the like), and/or any other structure having a plurality of rigid walls defining an inner volume 23. In some embodiments, one or more wall of the holding device 20 includes one or more transparent section, one or more vent or other aperture, and/or one or more other feature for allowing visual confirmation and/or other confirmation that an artifact 10 is positioned within the holding device 20. In some embodiments, the holding device 20 is configured to completely and/or at least partially conceal one or more artifact 10.

In some embodiments, the holding device 20 includes one or more clip, strap, and/or other feature (herein, a "clip") for selectively biasing the holding device 20 towards a closed and/or sealed configuration and/or for otherwise selectively preventing and/or otherwise inhibiting the holding device 20 from moving away from a closed and/or sealed configuration. In some embodiment, the clip is moveable between a first configuration and a second configuration. In some such embodiments, moving the clip from the first configuration to the second configuration allows the holding device 20 to move from the sealed configuration to the unsealed configuration and/or moves the holding device 20 from the secured configuration to the unsecured configuration. In some embodiments, the clip is configured to move between the second configuration and a third configuration. In some embodiments, moving the clip from the second configuration to the third configuration allows the holding device 20 to move from the closed configuration to the open configuration and/or moves the holding device 20 from the secured configuration to the unsecured configuration.

In some embodiments, the holding device 20 includes first 21 and second 22 portions that are configured to selectively engage with each other so as to move the holding device 20 to a closed and/or sealed configuration. In some embodiments, the first 21 and second 22 portions define corresponding features, such as hinges, lips, or the like, that are configured to selectively restrict movement of the first 21 and second 22 portions relative to each other. In some embodiments, one or more such feature is an engagement feature 25 that is configured to selectively engage with and/or be engaged by one or more lock, strap, band, or the like (herein, each a "locking mechanism"), thereby preventing and/or otherwise inhibiting the movement of the holding device 20 away from a sealed configuration and/or a closed configuration. In some embodiments, one or more locking mechanism is a verification mechanism 50 of the present invention.

In some embodiments, moving the holding device 20 from a sealed configuration and/or a closed configuration to an unsealed configuration and/or an open configuration, as applicable, includes moving a clip from a first and/or second configuration to a second and/or third configuration, as applicable, and/or moving a locking mechanism from a locked configuration to an unlocked configuration. In some embodiments, moving the locking mechanism from the locked configuration to the unlocked configuration includes breaking the locking mechanism and/or otherwise permanently damaging the locking mechanism. In some embodiments, the locking mechanism is incapable of moving from the unlocked configuration to the locked configuration after it is moved from the locked configuration to the unlocked configuration. In some embodiments, moving the holding device 20 from the sealed configuration and/or the closed configuration to the unsealed configuration and/or the open configuration, as applicable, includes removing at least part of the locking mechanism from at least part of the holding device 20.

In some embodiments, a holding device 20 is moveable to a verifiable configuration when the holding device is in a closed and/or sealed configuration. In some embodiments, an artifact 10 positioned in an inner volume 23 of the holding device 20 is moveable to a verifiable configuration by moving the holding device 20 to a verifiable configuration. In some embodiments, moving the holding device 20 to a verifiable configuration includes engaging a verification mechanism 50 with an engagement feature 25 of the holding device 20. In some embodiments, engaging a verification mechanism 50 with the holding device 20 includes moving the verification mechanism 50 to a locked and/or engaged configuration such that the holding device 20 is prevented and/or otherwise inhibited from moving away from the verifiable configuration (herein, each such configuration of the verification mechanism 50 being a "verifying configuration"). In this way, movement of the artifact 10 and/or the holding device 20 away from respective verifiable configurations includes moving the verification mechanism 50 away from the verifying configuration.

In some embodiments, engaging the verification mechanism 50 with the holding device 20 and moving the verification mechanism 50 to a verifying configuration causes the holding device 20 to move to a verifiable configuration. In some embodiments, moving the verification mechanism from a verifying configuration, such as to a disengaged and/or unlocked configuration, moves the holding device 20 away from the verifiable configuration, such as towards an unverifiable configuration. In some embodiments, moving the holding device 20 from a verifiable configuration to an unverifiable configuration includes removing at least part of the verification mechanism 50 from at least part of the holding device 20, such as by disengaging the verification mechanism 50 from an engagement feature 25 of the holding device 20.

In some embodiments, moving the verification mechanism 50 from the verifying configuration includes breaking the verification mechanism 50 and/or otherwise permanently damaging the verification mechanism 50. In some embodiments, the verification mechanism 50 is incapable of moving back to the verifying configuration after it is moved away from the verifying configuration. In some embodiments, the holding device 20 and/or the artifact 10 can be moved from a first verifiable configuration to a second verifiable configuration by moving a first verification mechanism 50 away from a verifying configuration with respect to such holding device 20 and/or artifact 10 and by moving a second verification mechanism to a verifying configuration with respect to the same. In some embodiments, the holding device 20 and/or the artifact 10 can be moved to a plurality of subsequent verifiable configurations by subsequently moving a plurality of verification mechanisms 50 to respective verifying configurations with respect to such holding device 20 and/or artifact 10.

Engagement Devices

Referring to FIGS. 3A-3F, some methods of the present invention include engaging one or more artifact 10 with an engagement device 30, thereby moving the artifact 10 from a disengaged configuration to an engaged configuration. In some embodiments, the engagement device 30 is moveable between an open configuration for selective engagement and/or disengagement of the artifact 10 and a closed configuration for preventing or otherwise inhibiting engagement and/or disengagement of the artifact 10.

In some embodiments, the engagement device 30 is configured to render one or more function and/or feature of the artifact 10 inaccessible and/or inoperable. In some embodiments, the engagement device 30 is a holster that is configured to render a hammer and/or trigger of a gun inaccessible and/or inoperable while the gun is engaged with the holster. In some embodiments, the engagement device 30 is a phone case that is configured to render one or more feature of the device, such as a screen of the device, inaccessible to a user, such as a driver of a vehicle and/or a student taking a test. In some embodiments, the engagement device 30 obscures and/or conceals all or part of one or more feature of the artifact 10 when the artifact is in the engaged configuration.

In some embodiments, moving the artifact 10 to a secured configuration includes engaging a locking mechanism with the engagement device 30 when the artifact 10 is in the engaged configuration such that the locking mechanism prevents or otherwise inhibits the artifact 10 from moving to a disengaged configuration. In some embodiments, moving the artifact 10 to a secured configuration includes moving the locking mechanism to a locked configuration. In some embodiments, moving the artifact 10 from the secured configuration to an unsecured configuration includes moving the locking mechanism from the locked configuration to an unlocked configuration. In some embodiments, moving the locking mechanism form the locked configuration to the unlocked configuration includes breaking the locking mechanism and/or breaking a verification mechanism 50 associated with the locking mechanism. In some embodiments, the locking mechanism is incapable of moving from the unlocked configuration to the locked configuration after it is moved from the locked configuration to the unlocked configuration. In some embodiments, disengaging the artifact 10 from the engagement device 30 includes disengaging the locking mechanism from at least one of the artifact 10 and the engagement device 30.

In some embodiments, an artifact 10 is moveable to a verifiable configuration by engaging the artifact 10 with an engagement device 30 and engaging a verification mechanism 50 with the artifact 10, the engagement device 30, and/or a locking device. In some embodiments, moving the artifact 10 to the verifiable configuration includes moving the verification mechanism 50 to a locked and/or engaged configuration such that the artifact 10 is prevented and/or otherwise inhibited from disengaging from the engaging device (herein, each such configuration of the verification mechanism 50 being a "verifying configuration"). In this way, movement of the artifact 10 away from the verifiable configuration includes moving the verification mechanism 50 away from the verifying configuration.

In some embodiments, moving the verification mechanism 50 from the verifying configuration includes breaking the verification mechanism 50 and/or otherwise permanently damaging the verification mechanism 50. In some embodiments, the verification mechanism 50 is incapable of moving back to the verifying configuration after it is moved away from the verifying configuration. In some embodiments, the artifact 10 can be moved from a first verifiable configuration to a second verifiable configuration by moving a first verification mechanism 50 away from a verifying configuration with respect to such artifact 10 and by moving a second verification mechanism to a verifying configuration with respect to the same. In some embodiments, the artifact 10 can be moved to a plurality of subsequent verifiable configurations by subsequently moving a plurality of verification mechanisms 50 to respective verifying configurations with respect to such artifact 10.

Proximity Devices

Figure 4:
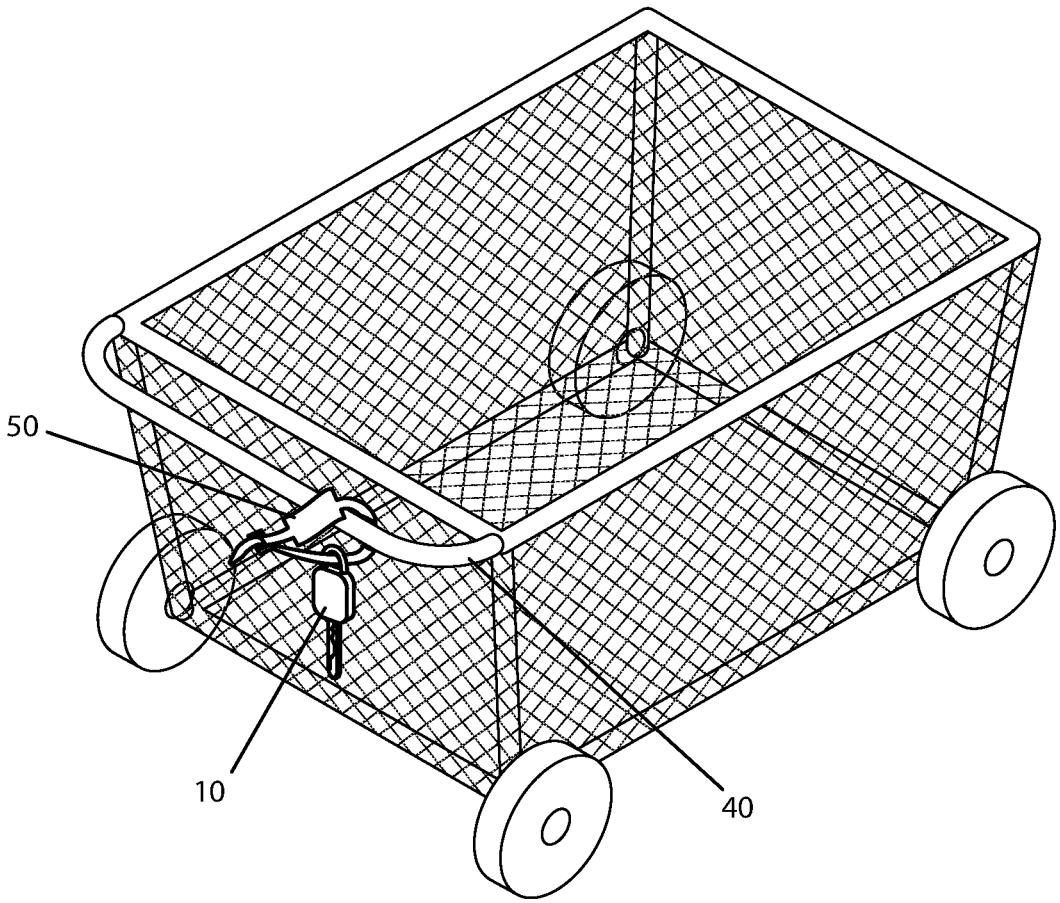
FIG. 4 shows a verification device in a verification configuration, the verification device being configured to prevent an artifact from moving beyond a first distance from a proximity device.

Referring to FIG. 4, some methods of the present invention include positioning the artifact 10 adjacent to and/or otherwise positioning the artifact 10 relative to one or more person, place, or item (i.e. a "proximity device" or an "anchor" 40). In some embodiments, the artifact 10 is associated with the anchor 40 so as to prevent and/or otherwise inhibit the artifact 10 from being moved away from the anchor 40. In some embodiments, the anchor 40 is associated with one or more person, place, and/or item (herein, each a "reference item") and/or is selected due to its relative position to and/or its relationship with one or more reference item such that associating the artifact 10 with the anchor 40 causes the artifact 10 to be sufficiently associated with and/or sufficiently disassociated from such reference item, as applicable.

In some embodiments, moving the artifact 10 to a secured configuration includes engaging a locking mechanism with the artifact 10 and the anchor 40, thereby associating the artifact 10 with the anchor 40. In some embodiments, moving the artifact 10 to a secured configuration includes moving the locking mechanism to a locked configuration. In some embodiments, moving the artifact 10 from the secured configuration to an unsecured configuration includes moving the locking mechanism from the locked configuration to an unlocked configuration. In some embodiments, moving the locking mechanism form the locked configuration to the unlocked configuration includes breaking the locking mechanism and/or breaking a verification mechanism 50 associated with the locking mechanism. In some embodiments, the locking mechanism is incapable of moving from the unlocked configuration to the locked configuration after it is moved from the locked configuration to the unlocked configuration. In some embodiments, moving the artifact 10 and the anchor 40 away from each other includes disengaging the locking mechanism from at least one of the artifact 10 and the anchor 40.

In some embodiments, an artifact 10 is moveable to a verifiable configuration by engaging a verification mechanism 50 with the artifact 10, an anchor 40, and/or a locking device. In some embodiments, moving the artifact 10 to the verifiable configuration includes moving the verification mechanism 50 to a locked and/or engaged configuration so as to restrict movement of the artifact 10 relative to the anchor 40 (herein, each such configuration of the verification mechanism 50 being a "verifying configuration"). In this way, movement of the artifact 10 away from the verifiable configuration includes moving the verification mechanism 50 away from the verifying configuration.

In some embodiments, moving the verification mechanism 50 from the verifying configuration includes breaking the verification mechanism 50 and/or otherwise permanently damaging the verification mechanism 50. In some embodiments, the verification mechanism 50 is incapable of moving back to the verifying configuration after it is moved away from the verifying configuration. In some embodiments, the artifact 10 can be moved from a first verifiable configuration to a second verifiable configuration by moving a first verification mechanism 50 away from a verifying configuration with respect to such artifact 10 and by moving a second verification mechanism to a verifying configuration with respect to the same. In some embodiments, the artifact 10 can be moved to a plurality of subsequent verifiable configurations by subsequently moving a plurality of verification mechanisms 50 to respective verifying configurations with respect to such artifact 10.

Verification Mechanisms

Figure 5:
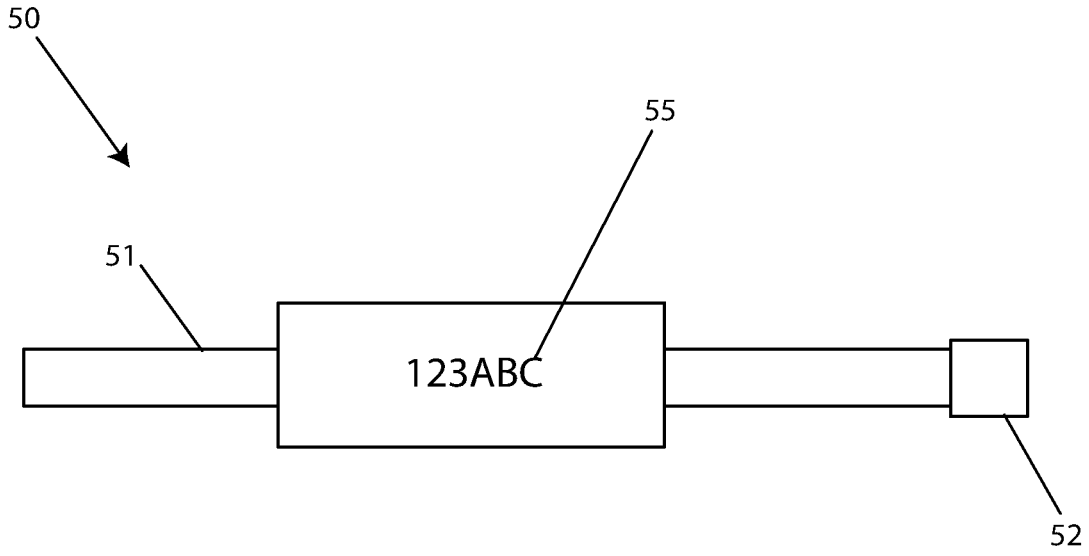
FIG. 5 shows a verification mechanism of the present invention.

Referring to FIG. 5, some embodiments of the verification mechanism 50 include a first portion 51, such as a band, a clip, or the like, for selectively engaging with one or more artifact 10, securing device, locking device, and/or the like (each being an "engagement device"), so as to move the artifact 10 to a verifiable configuration. In some embodiments, the verification mechanism 50 includes indicia 55, such as a serial number, a bar code, a QR code, or the like, that is unique from indicia of one or more other verification mechanism 50 of the present invention. In some embodiments, the indicia 55 of a first verification mechanism 50 is unique from an indicia 55 of each of a plurality of other verification mechanisms 50. In some embodiments, the indicia 55 of each of the plurality of verification mechanisms 50 is unique from indicia 55 of each of the other verification mechanisms 50 of the plurality of verification mechanisms 50.

In some embodiments, the verification mechanism 50 is configured to move from a first configuration to a second configuration. In the first configuration, the verification mechanism 50 is configured to selectively engage with one or more engagement device. In the second configuration, the verification mechanism 50 is configured to inhibit disengagement from one or more engagement device. In some embodiments, the verification mechanism 50 includes a second portion 52 extending from and/or otherwise coupled to the first portion 51. In some embodiments, the second portion 52 is coupled to a proximal end of the first portion 51 and is configured to selectively receive a distal end of the first portion, thereby allowing the verification mechanism 50 to move from the first to the second configuration. In some embodiments, the second portion 52 is configured so as to prevent the verification mechanism 50 to move away from the second configuration.

In some embodiments, engaging a verification mechanism 50 with one or more engagement device associated with an artifact 10 and moving the verification mechanism 50 to the second configuration moves the artifact 10 to a verifiable configuration while moving the verification mechanism 50 to a verifying configuration. In some embodiments, moving the verification mechanism 50 to a verifying configuration includes exposing the indicia 55 of the verification mechanism 50, thereby enabling one or more person and/or system to view and/or record the indicia 55. In some embodiments, the indicia 55 is at least partially concealed until the verification mechanism 50 is moved to a verifying mechanism. In some embodiments, the indicia 55 is destroyed or at least partially damaged when the verification mechanism 50 is moved away from the verifying configuration.

In some embodiments, the verification mechanism 50 is configured to break and/or otherwise incur damage when the verification mechanism 50 is moved away from a verifying configuration. In some embodiments, the verification mechanism 50 is sized to accommodate some adjustment and/or repositioning of the verification mechanism 50 relative to a respective artifact 10 and/or is formed from a material, such as a plastic and/or rubber material, that is relatively resilient to bending and/or stretching and/or is otherwise designed to accommodate the same, thereby accommodating some adjustment and/or repositioning of an engagement device and/or artifact 10 while the artifact remains in a verifiable configuration. In some embodiments, the verification mechanism 50 is designed with one or more feature for allowing a user to selectively move the verification mechanism 50 away from the verifying configuration, thereby moving the artifact 10 away from the verifiable configuration. In some embodiments, the verification mechanism 50 is configured so as to break or otherwise move away from the verifying configuration as the artifact 10 is moved away from the verifiable configuration, such as when a user moves the artifact 10 away from the verifiable configuration, when the artifact 10 is caused to and/or allowed to be adjusted and/or repositioned beyond the verifiable configuration, or otherwise.

Methods of Verifying Configurations

The present invention further includes a method of verifying a configuration and/or a position of one or more artifact 10. In some embodiments, the method includes engaging a first verification mechanism with one or more engagement device associated with a first artifact, thereby moving the first artifact to a first verifiable configuration and moving the first verification mechanism to a verifying configuration.

In some embodiments, the method includes creating a first verification record associated with the first verifiable configuration of the first artifact and storing the first verification record for future reference. In some embodiments, creating the first verification record includes utilizing a first electronic device to scan a code of the first verification mechanism, to take a picture of the first verification mechanism, and/or to otherwise record information that is sufficient to provide at least some evidence of the first artifact being in the first verifiable configuration (each such action being a "scanning operation" and the initial such action associated with creating the first verification record being a "first scanning operation"). In some embodiments, the first verification record includes a time stamp or the like (herein, "timestamp") for associating the first verification record with the first time, thereby providing at least some evidence of the first artifact being in the first verifiable configuration at the first time.

In some embodiments, the electronic device includes one or more scanning feature and/or other feature (such as a camera or the like, each such feature being a "scanning feature") for performing one or more scanning operation. In some embodiments, the scanning feature is configured to capture an image and/or to otherwise obtain information associated with a scanned item, such as information associated with the first verification mechanism and/or one or more subsequent verification mechanism (the "scan information"). In some embodiments, the scan information is processed by a processor of the electronic device and/or a processor of another device and/or system so as to determine whether the scan information matches scan information associated with one or more other artifact 10 and/or scanning operation, such as information associated with one or more verification record. In some embodiments, one or more verification record and/or information associated with one or more verification record is stored in a database of the electronic device and/or in a database of another electronic device and/or system. In some embodiments, the electronic device is in data communication with one or more database of one or more other electronic device and/or system.

In some embodiments, the scan information is augmented with a timestamp and/or is otherwise augmented and/or the verification record otherwise associates the timestamp with respective scan information. In some embodiments, the verification record includes an authenticity stamp and/or another indication that at least some information associated with the verification record has been authenticated by the electronic device, by some other device (such as a system operated by an independent third-party entity and/or authority), and/or by a person (such as by a user of the electronic device, an owner and/or user of the an artifact, and/or an independent third party, such as a mediator, a bailor, a bailee, an officer, and/or one or more other person, entity, and/or system) (each being an "authentication provider").

In some embodiments, the method includes prompting one or more authentication provider to provide an authenticity stamp and/or to otherwise authenticate one or more verification record. In some embodiments, the method includes prompting the authentication provider and/or one or more other user and/or system to perform a second scanning operation, thereby creating at least part of a second verification record. In some embodiments, information associated with the second verification record is compared with information associated with the first verification record, thereby providing the authentication provider with information associated with the same. In some such embodiments, the system creates a historical record associated with the first verification mechanism. In some embodiments, the historical record links at least two verification records associated with the first verification mechanism and/or otherwise includes information from at least two such verification records, such as time stamp information, thereby providing an indication that the first artifact has remained in a first verifiable configuration at least from a first time to a second time. In some embodiments, the system is configured to create a plurality of historical records associated with one or more artifact and/or one or more verifiable configurations of such artifacts.

In some embodiments, the system is configured to compare a first verification record with a second verification record, thereby providing a user with an indication of whether a first artifact has moved from a first verifiable configuration. In some such embodiments, the system provides an indication to a user if the first and second verification records are associated with different verification mechanisms, thereby providing the user with an indication that an associated artifact may have moved away from the verifiable configuration. In this way, in some circumstances, a user may be prompted to further investigate whether the artifact has been tampered with and/or taken, such as by an unauthorized user.

In various embodiments of the instant invention, a computer program of a central management system for a website and/or software applications is located on a central server connected via a communications network to various computing devices of system users. In some embodiments, the computing devices of system users are mobile computing devices, such as a smart phone that communicates with the central management system via an app installed on the device.

In some embodiments of the invention, in which the users utilize a smart phone app, tablet, pc or other personal computing device (collectively referred to herein as an "app") for connecting with the central management system, the user has the option of using the app, or sharing data, etc. with the app to other systems and/or devices. In some embodiments, the app requires stores login credentials for the user.

Various embodiments of the computer program, devices, systems, and methods of the present invention are implemented in hardware, software, firmware, or combinations thereof using central management system of the invention, which broadly comprises server devices, computing devices, a communications network, and a membership ID (account number, etc.). Various embodiments of the server devices include computing devices that provide access to one or more general computing resources, such as Internet services, electronic mail services, data transfer services, and the like. In some embodiments the server devices also provides access to a database that stores information and data, with such information and data including, without limitation, system user information (e.g. ID, account number, etc.), or the like, or other information and data necessary and/or desirable for the implementation of the computer program, devices, systems, and methods of the present invention.

Various embodiments of the server devices and the computing devices include any device, component, or equipment with a processing element and associated memory elements. In some embodiments the processing element implements operating systems, and in some such embodiments is capable of executing the computer program, which is also generally known as instructions, commands, software code, executables, applications (apps), and the like. In some embodiments the processing element includes processors, microprocessors, microcontrollers, field programmable gate arrays, and the like, or combinations thereof. In some embodiments the memory elements are capable of storing or retaining the computer program and in some such embodiments also store data, typically binary data, including text, databases, graphics, audio, video, combinations thereof, and the like. In some embodiments the memory elements also are known as a "computer-readable storage medium" and in some such embodiments include random access memory (RAM), read only memory (ROM), flash drive memory, floppy disks, hard disk drives, optical storage media such as compact discs (CDs or CDROMs), digital video disc (DVD), Blu-Ray™, and the like, or combinations thereof. In addition to these memory elements, in some embodiments the server devices further include file stores comprising a plurality of hard disk drives, network attached storage, or a separate storage network.

Various embodiments of the computing devices specifically include mobile communication devices (including wireless devices), work stations, desktop computers, laptop computers, palmtop computers, tablet computers, portable digital assistants (PDA), smart phones, wearable devices and the like, or combinations thereof. Various embodiments of the computing devices also include voice communication devices, such as cell phones or landline phones. In some preferred embodiments, the computing device has an electronic display, such as a cathode ray tube, liquid crystal display, plasma, or touch screen that is operable to display visual graphics, images, text, etc. In certain embodiments, the computer program of the present invention facilitates interaction and communication through a graphical user interface (GUI) that is displayed via the electronic display. The GUI enables the user to interact with the electronic display by touching or pointing at display areas to provide information to the user control interface, which is discussed in more detail below. In additional preferred embodiments, the computing device includes an optical device such as a digital camera, video camera, optical scanner, or the like, such that the computing device can capture, store, and transmit digital images and/or videos, bar codes or other identification information.

In some embodiments the computing devices includes a user control interface that enables one or more users to share information and commands with the computing devices or server devices. In some embodiments, the user interface facilitates interaction through the GUI described above or, in other embodiments comprises one or more functionable inputs such as buttons, keyboard, switches, scrolls wheels, voice recognition elements such as a microphone, pointing devices such as mice, touchpads, tracking balls, styluses. Embodiments of the user control interface also include a speaker for providing audible instructions and feedback. Further, embodiments of the user control interface comprise wired or wireless data transfer elements, such as a communication component, removable memory, data transceivers, and/or transmitters, to enable the user and/or other computing devices to remotely interface with the computing device.

In various embodiments the communications network is wired, wireless, and/or a combination thereof, and in various embodiments includes servers, routers, switches, wireless receivers and transmitters, and the like, as well as electrically conductive cables or optical cables. In various embodiments the communications network includes local, metro, and/or wide area networks, including the Internet and/or other cloud networks. Furthermore, some embodiments of the communications network include cellular and/or mobile phone networks, as well as landline phone networks, public switched telephone networks, fiber optic networks, or the like.

Various embodiments of both the server devices and the computing devices are connected to the communications network. In some embodiments server devices communicate with other server devices or computing devices through the communications network. Likewise, in some embodiments, the computing devices communicate with other computing devices or server devices through the communications network. In various embodiments, the connection to the communications network is wired, wireless, and/or a combination thereof. Thus, in some such embodiments, the server devices and the computing devices include components to establish a wired and/or a wireless connection.

Various embodiments of the computer program of the present invention run on computing devices. In other embodiments the computer program runs on one or more server devices. Additionally, in some embodiments a first portion of the program, code, or instructions execute on a first server device or a first computing device, while a second portion of the program, code, or instructions execute on a second server device or a second computing device. In some embodiments, other portions of the program, code, or instructions execute on other server devices as well. For example, in some embodiments information is stored on a memory element associated with the server device, such that the information is remotely accessible to users of the computer program via one or more computing devices. Alternatively, in other embodiments the information is directly stored on the memory element associated with the one or more computing devices of the user. In additional embodiments of the present invention, a portion of the information is stored on the server device, while another portion is stored on the one or more computing devices. It will be appreciated that in some embodiments the various actions and calculations described herein as being performed by or using the computer program are performed by one or more computers, processors, or other computational devices, such as the computing devices and/or server devices, independently or cooperatively executing portions of the computer program.

Various embodiments of the present invention are accessible to one or more user via one or more electronic resource, such as an application, a mobile "app," or a website. In certain embodiments, portions of the computer program are embodied in a stand-alone program downloadable to a user's computing device or in a web-accessible program that is accessible by the user's computing device via the network. For some embodiments of the stand-alone program, a downloadable version of the computer program is stored, at least in part, on the server device. A user downloads at least a portion of the computer program onto the computing device via the network. After the computer program has been downloaded, the program is installed on the computing device in an executable format. Some embodiments of the web-accessible computer program are configured to allow a user to simply access the computer program via the network (e.g., the Internet) with the computing device.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A method of utilizing a first verification mechanism to verify a configuration of an artifact over a first period of time, the method comprising:

associating the first verification mechanism with the artifact such that the first verification mechanism is moved to a verifying configuration and the artifact is moved to a first verifiable configuration, wherein moving the artifact away from the first verifiable configuration includes moving the first verification mechanism away from the verifying configuration, utilizing a scanning feature of a first electronic device to perform a first scanning operation at a first point in time, thereby obtaining scan information for a first verification record, wherein the artifact is in the first verifiable configuration at the first point in time, wherein the first scanning operation includes obtaining information associated with the first verification mechanism, wherein the first verification record includes a time stamp representing the first point in time, thereby providing evidence that the artifact was in the first verifiable configuration at the first point in time, wherein the first verification mechanism includes a unique identifier distinguishing the first verification mechanism from a second verification mechanism, information associated with the unique identifier being included in the first verification record so as to enable the first verification record to be distinguishable from a second verification record associated with the second verification mechanism, wherein the first verification mechanism is incapable of moving back to the verifying configuration after the first verification mechanism is moved away from the verifying configuration, and wherein the first verification mechanism is configured to quickly and easily move away from the verifying configuration such that the first verification mechanism does not inhibit the artifact from moving away from the first verifiable configuration, thereby allowing the artifact to remain in a readily accessible configuration while the first verification mechanism remains in a verifying configuration.

2. The method of claim 1, wherein:

the artifact is positioned within an inner volume of a holding device when the artifact is in the first verifiable configuration;

associating the first verification mechanism with the artifact includes engaging the first verification mechanism with an engagement feature of the holding device, thereby moving the holding device to a second verifiable configuration; and the artifact is associated with the holding device such that moving the holding device to the second verifiable configuration moves the artifact to the first verifiable configuration.

3. The method of claim 2, wherein the artifact is a firearm, wherein the holding device is a gun case, wherein moving the holding device away from the second verifiable configuration comprises opening the holding device such that the artifact moves away from the first verifiable configuration, wherein the first verification mechanism is configured to quickly and easily move away from the verifying configuration as the holding device moves away from the second verifiable configuration such that the first verification mechanism does not inhibit the holding device from opening, thereby allowing the holding device to remain in a readily openable configuration while the first verification mechanism remains in a verifying configuration, and wherein the first scanning operation comprises taking a picture of the first verification mechanism.

4. The method of claim 2, wherein moving the artifact out of the inner volume of the holding device includes moving the artifact away from the first verifiable configuration.

5. The method of claim 1, wherein the artifact is engaged with an engagement device when the artifact is in the first verifiable configuration and wherein associating the first verification mechanism with the artifact includes engaging the first verification mechanism with at least one of the engagement device and the artifact.

6. The method of claim 5, wherein associating the first verification mechanism with the artifact includes engaging the first verification mechanism with the engagement device and the artifact.

7. The method of claim 5, wherein the artifact is a firearm, wherein the engagement device is a holster, wherein disengaging the artifact from the engagement device includes moving the artifact away from the first verifiable configuration, wherein the first verification mechanism is configured to quickly and easily move away from the verifying configuration as the artifact is disengaged from the engagement device such that the first verification mechanism does not inhibit such disengagement, thereby allowing the artifact to remain in a readily accessible configuration while the first verification mechanism remains in a verifying configuration, and wherein the first scanning operation consists of utilizing a verification application to take and store a picture of the first verification mechanism.

8. The method of claim 1, wherein the artifact is positioned within a first distance of a proximity device when the artifact is in the first verifiable configuration.

9. The method of claim 8, wherein the artifact is a firearm, wherein the proximity device is associated with one of a glove box and a trunk, wherein moving the artifact further than a first distance from the proximity device includes moving the artifact away from the first verifiable configuration, and wherein the first verification mechanism is configured to quickly and easily move away from the verifying configuration as the artifact is moved further than the first distance from the proximity device such that the first verification mechanism does not inhibit such movement, thereby allowing the artifact to remain in a readily accessible configuration while the first verification mechanism remains in a verifying configuration.

10. The method of claim 1, further comprising:

utilizing one of the scanning feature of the first electronic device or a scanning feature of a second electronic device to perform a second scanning operation associated with the artifact, thereby obtaining scan information for a second verification record, wherein the artifact is in the first verifiable configuration at the second point in time, wherein the second verification record includes a time stamp representing the second point in time, thereby providing evidence that the artifact was in the first verifiable configuration at the second point in time, and wherein a beginning and an end of the first period of time are defined by the first and second points in time, respectively.

11. A method of determining whether a configuration of an artifact has moved away from a first verifiable configuration, the method comprising:

associating a first verification mechanism with the artifact such that the first verification mechanism is moved to a verifying configuration and the artifact is moved to the first verifiable configuration, wherein moving the artifact away from the first verifiable configuration includes moving the first verification mechanism away from the verifying configuration;

utilizing a scanning feature of a first electronic device to perform a first scanning operation while the artifact is in the first verifiable configuration, thereby obtaining scan information for a first verification record, the scan information being associated with the first verification mechanism;

utilizing one of the scanning feature of the first electronic device or a scanning feature of a second electronic device to perform a second scanning operation, thereby obtaining scan information for a second verification record, the scan information being associated with a verification mechanism associated with the artifact during the second scanning operation, such verification mechanism being in a verifying configuration during the second scanning operation;

comparing the second verification record with the first verification record, thereby creating a comparison record; and determining, based on the comparison record, whether the verification mechanism associated with the artifact during the second scanning operation is the first verification mechanism, wherein the second scanning operation is performed after the first scanning operation, wherein the first verification record includes information associated with the first verification mechanism, thereby providing evidence that the first verification mechanism was in its verifying configuration during the first scanning operation, wherein the first verification mechanism is incapable of moving back to the verifying configuration after the first verification mechanism is moved away from the verifying configuration, and wherein the first verification mechanism is configured to quickly and easily move away from the verifying configuration such that the verification mechanism does not inhibit the artifact from moving away from the verifiable configuration, thereby allowing the artifact to remain in a readily accessible configuration while the verification mechanism remains in a verifying configuration.

12. The method of claim 11, wherein the first verification mechanism includes a unique identifier for distinguishing the first verification mechanism from each verification mechanism of a plurality of other verification mechanisms, the first verification record including information associated with the unique identifier of the first verification mechanism such that the first verification record is distinguishable from a verification record associated with any of the plurality of verification mechanisms.

13. The method of claim 12, wherein moving the first verification mechanism away from its verifying configuration causes damage to the unique identifier of the first verification mechanism such that a subsequent scanning operation associated with the first verification mechanism would obtain scan information that is distinguishable from scan information obtained during the first scanning operation.

14. The method of claim 13, wherein the comparing step includes identifying discrepancies associated with the first verification mechanism being moved away from its verifying configuration.

15. The method of claim 14, wherein the comparing step includes identifying differences between the first verification mechanism and the verification mechanism associated with the artifact during the second scanning operation when the verification mechanism associated with the artifact during the second scanning operation is not the first verification mechanism.

16. The method of claim 11, wherein the comparing step includes identifying differences between the first verification mechanism and the verification mechanism associated with the artifact during the second scanning operation when the verification mechanism associated with the artifact during the second scanning operation is not the first verification mechanism.

17. A verification system for verifying a configuration of an artifact, the verification system comprising:

a first verification mechanism for moving the artifact to a first verifiable configuration, the first verification mechanism including a unique identifier distinguishing the first verification mechanism from a plurality of other verification mechanisms;

a scanning device for scanning the unique identifier of the first verification mechanism during a first scanning operation while the artifact is in the first verifiable configuration, thereby obtaining scan information for a first verification record; and a processor for comparing the first verification record to a second verification record, the second verification record being associated with a second scanning operation, wherein moving the artifact away from the first verifiable configuration includes moving the first verification mechanism away from a verifying configuration, wherein the first verification mechanism is incapable of moving back to the verifying configuration after it is moved away from the verifying configuration, and wherein the first verification mechanism is configured to quickly and easily move away from the verifying configuration such that the verification mechanism does not inhibit the artifact from moving away from the verifiable configuration, thereby allowing the artifact to remain in a readily accessible configuration while the verification mechanism remains in a verifying configuration.

18. The system of claim 17, wherein moving the first verification mechanism away from its verifying configuration causes damage to the unique identifier of the first verification mechanism such that a subsequent scanning operation associated with the first verification mechanism would obtain scan information that is distinguishable from scan information obtained during the first scanning operation.

19. The system of claim 18, wherein the processor is configured to identify discrepancies associated with the first verification mechanism being moved away from its verifying configuration.

20. The system of claim 17, wherein the processor is configured to identifying differences between the first verification mechanism and each of the other verification mechanisms of the plurality of verification mechanisms.

* * * * *